US006561091B1

(12) United States Patent
Steve

(10) Patent No.: US 6,561,091 B1
(45) Date of Patent: May 13, 2003

(54) PRINTING PROCESS COMBINING CONVENTIONAL AND BRAILLE PRINTING WITH THE AID OF AN OFF-SET-TYPE PRINTING MACHINE

(76) Inventor: Christian Steve, Saint Vaast du Vall, Totes (FR)

( * ) Notice: Subject to any disclaimer, the term of this patent is extended or adjusted under 35 U.S.C. 154(b) by 0 days.

(21) Appl. No.: 09/869,308

(22) PCT Filed: Jan. 20, 2000

(86) PCT No.: PCT/IB00/00057

§ 371 (c)(1),
(2), (4) Date: Jul. 20, 2001

(87) PCT Pub. No.: WO00/43211

PCT Pub. Date: Jul. 27, 2000

(30) Foreign Application Priority Data

Jan. 22, 1999 (FR) ..... 99 00798

(51) Int. Cl.[7] ..... B41F 19/02; B41F 13/00; B41F 5/00; B41J 3/32

(52) U.S. Cl. ..... 101/212; 101/6; 101/23; 101/216; 400/109.1

(58) Field of Search ..... 101/18, 22, 23, 101/212, 12, 13, 15–17, 4–6; 400/109.1, 127–130, 131, 135, 120.01, 118.2

(56) References Cited

FOREIGN PATENT DOCUMENTS

| | | |
|---|---|---|
| EP | 0 667 244 | 8/1995 |
| FR | 2 717 420 | 9/1995 |

OTHER PUBLICATIONS

Patent Abstracts of Japan, vol. 009, No. 179 (M–399), Jul. 24, 1985 JP 60 048394 A (Rejin Kogyo KK) Mar. 16, 1985.

*Primary Examiner*—Huan Tran
*Assistant Examiner*—An H. Do
(74) *Attorney, Agent, or Firm*—Jacobson Holman PLLC

(57) ABSTRACT

A printing process combining conventional and Braille printing using an offset-type printing machine. The process involves the following operations: putting on a page the text and/or images that are to be printed in a conventional manner and putting on a page the text and/or images that are to be Braille printed; printing one photolyte for every page that is to be printed in a conventional manner and one for every page that is to be Braille printed, preparing a printing plate by photolyte, the plate having a support side and a printing side containing the motif corresponding to the one on the photolyte, fixing the Braille printing plate by its support side to the counter-pressure cylinder in one of the printing stations, fixing the conventional printing plates by its support face to the plate cylinder in the other printing stations and printing the sheets to be printed that have gone one by one through the rubber cylinders and the counter-pressure cylinders.

6 Claims, 1 Drawing Sheet

PRINTING PROCESS COMBINING CONVENTIONAL AND BRAILLE PRINTING WITH THE AID OF AN OFF-SET-TYPE PRINTING MACHINE

This application is a national phase under 35 USC §371 of PCT International Application No. PCT/IB00/00057 which has an International Filing Date of Jan. 20, 2000, which designated the United States of America and was published in Spanish and claims priority from 99-00798 filed Jan. 22, 1999, in France which is claimed herein.

FIELD OF THE INVENTION

This method consists of the following operations: the page-setting of the text and/or the images that will be printed in the usual way; the page-setting of the text that will be printed in Braille; the printing of the films (25) in the ratio of one per page that will be printed in the usual way, and of one per page that will be printed in Braille, the carrying out of a printing plate (27) per film (25) that contains a printing side in which is represented the motif that corresponds to the one that figures in the film; the fixing of the Braille printing plate (27) in the margin cylinder (5) of one of the printing posts (28 at 31) of the offset printing machine; the fixing of the usual printing plates (35) in the plate carrier cylinder (1) of the other printing posts (28 at 30); the printing of the sheets to be printed which have passed one by one through the blanket carrier cylinders (4) and the margin cylinders (5).

This invention refers to a printing method to produce, thanks to an offset printing machine, documents that can be read at the same time by sighted and blind people.

SUMMARY OF THE INVENTION

In a general way, it is known that the offset printing machines can produce an important quantity of printed documents at low cost. A machine of these characteristics usually includes one or several printing posts, each one of them consisting of a plate carrier cylinder equipped with both printing and damper rollers, a blanket carrier cylinder and a counter-pressure cylinder or margin cylinder. The plate carrier cylinder is covered with a plate containing the motif to be printed. The blanket carrier cylinder is covered with a blanket manufactured in a flexible and elastic material that receives from the plate carrier cylinder a reversed image of the motif that will be printed and that figures on the plate.

The virgin sheets that will be printed are initially heaped up in a feeding post and are transmitted one to one to a margin area before passing between the blanket and the margin cylinder where printing is made. Once printed, the sheets are heaped up in a reception post.

When we want to print on both sides, the offset printing machine is provided of at least two printing posts where there is a device of inversion of the sheets. Also, if we want to print in several colours or in four colours, the machine should have as many printing posts as colours and sides to be printed.

On the other hand, in the Braille printing methods, typography techniques are used whose start is very slow and therefore very expensive.

The purpose of this invention is to allow an offset machine of the type mentioned above to make, simultaneously and in large quantities, classic and Braille printing, and this, without having to make any type of change in the machine, in order to make newspapers and books accessible at the same time to both sighted and blind people.

To this end, it proposes a printing method, like the one described previously, combining both usual and Braille printing, in an offset machine equipped with at least two printing posts. This method comprises the following operations:

- the page-setting of the text and/or the images that will be printed in the usual way, and the page-setting of the text that will be printed in Braille,
- from the aforementioned page-settings, the printing of at least one film per page that will be printed in the usual way, and of one film per page that will be printed in Braille,
- the production of a printing plate per film equipped with a support side and with a printing side containing the motif corresponding to the one that figures on the film,
- the fixing of the Braille printing plate by its support side to the margin cylinder of one of the printing posts, and the fixing of the usual printing plates by their support side to the plate carrier cylinder of the other printing posts, and
- the printing of the sheets to be printed and that have passed one by one and successively between the blanket carrier cylinders and the counter-pressure cylinders of each printing post.

In this way, the text in Braille is printed in relief due to the local deformations of the sheets that pass through the blanket carrier cylinder and the counter-pressure cylinder covered with the Braille relief printing plate of one of the printing posts, while the text printed in the usual way is printed in the other posts of the offset machine.

Thanks to these dispositions, the invention considerably increases the field of application of existing offset machines. Therefore a better profitability of the machines is obtained and it is possible not only to carry out Braille printing at a very low price, but also to produce documents accessible to both sighted and blind people.

Advantageously, the Braille printing plate is made thanks to a photogravure technique.

According to a particular embodiment of the invention, this method also comprises the selection of at least a part of the text that will be printed in the usual way, and the automatic conversion to Braille of the selected text.

Advantageously, the sheets are printed in the habitual way on both sides. Like this, as Braille printing can only be done on one of the sides that are going to be printed, the text printed in the usual way can be distributed on two pages and associated to images, such as for example pictures, and possibly, publicity can be added in the case of newspapers.

Like this it is possible to make, in big quantities and at low prices, newspapers, magazines and books that are accessible at the same time to both sighted and blind, people.

BRIEF DESCRIPTION OF THE DRAWINGS

A way of producing the invention shall be described next, by way of limitative example, with reference to the enclosed figures of which.

DETAILED DESCRIPTION OF THE PREFERRED EMBODIMENTS

Figure 1:
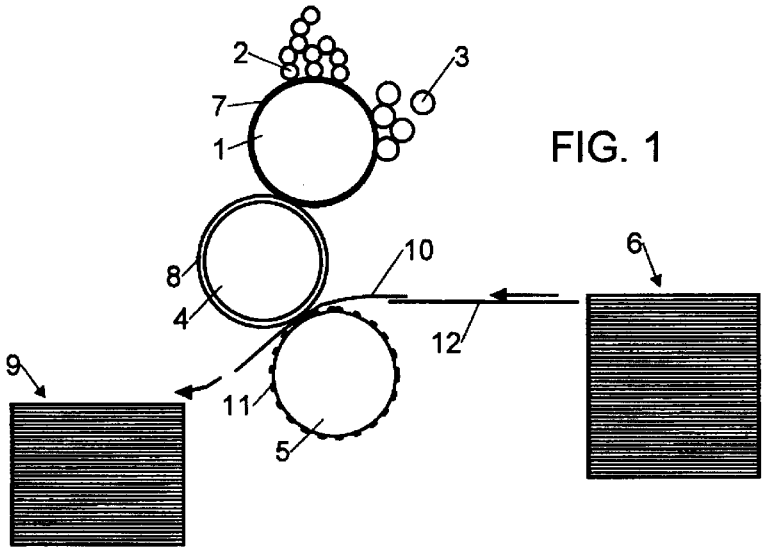
FIG. 1 schematically represents a printing post of an offset printing machine.

With reference to FIG. 1, an offset printing machine comprises in a classic way, as it has already been mentioned, a plate carrier cylinder 1 covered with a printing plate 7, and equipped with printer rollers 2 and with damper rollers 3, a blanket carrier cylinder 4 covered with a blanket 8 made in a flexible and elastic material, and a pressure cylinder or margin cylinder 5. The virgin sheets to be printed are heaped in a feeding post 6 and are transmitted one by one to a margin area 12 before passing through the blanket 8 and the margin cylinder 5 where printing is carried out. The printed sheets are later heaped on a reception post 9.

Damper rollers 2 and printer rollers 3 damp and dye the printing plate 7. When cylinders 1, 4, 5 rotate, the motif that figures on plate 7 is transferred to blanket 8 in the form of a reversed image. When a paper sheet passes through blanket 8 and margin cylinder 5, the image of the blanket is transferred to the paper sheet: this new transfer reverses the image again so that it appears on the sheet like it appears on plate 7.

To make a Braille printing with this kind of machine (which has not been conceived for this kind of printing), the invention intends to fix a relief printing plate 11 to margin cylinder 5 of a printing post of the offset machine that has not been used to make the usual printing. Plate 11 should cover the totality of the cylindrical surface of the margin cylinder. Like this, sheet 10 that passes through blanket carrier cylinder 4 is printed in Braille thanks to plate 11 and to margin cylinder 5.

Figure 2:
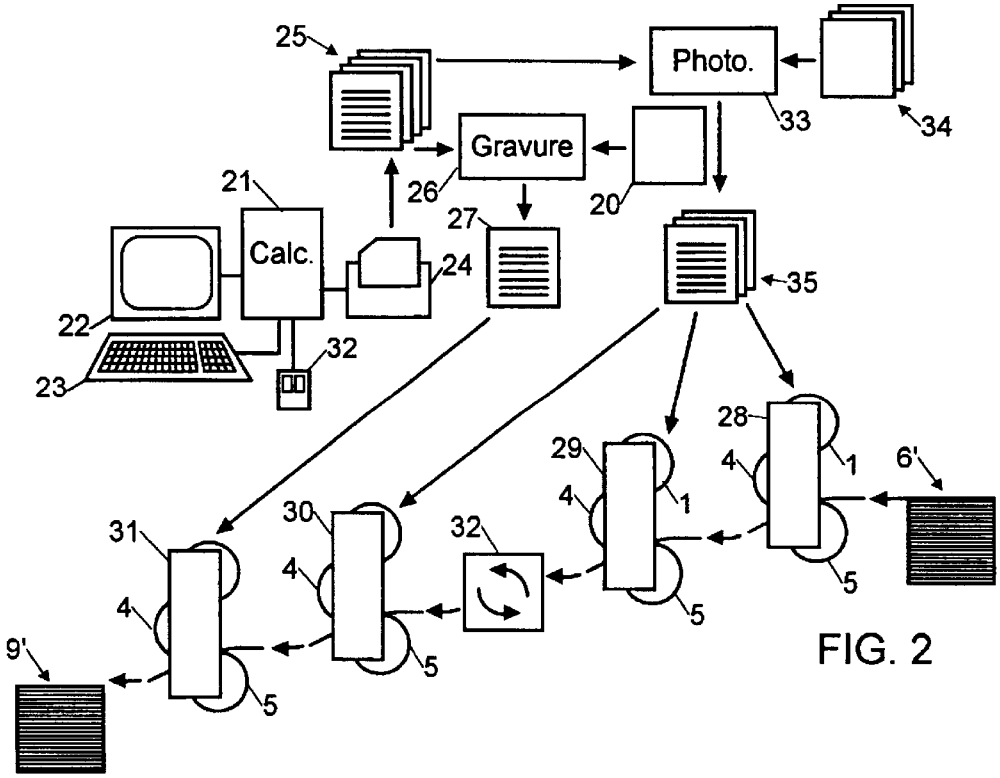
FIG. 2 schematically illustrates the different stages of the method according to the invention.

With reference to FIG. 2, and according to the invention method, the page-setting of the elements (texts, images) to be printed is carried out, with the aid of calculator 21, for example of the micro-computer type, directed by an adapted program, and connected to a visualization screen 22 and to execution means like keyboard 23 and mouse 32.

Therefore, the page setting of the text and the images to be printed in the usual way is done first. Next the text to be printed is converted to Braille by calculator 21 thanks to the program conceived to such effect, and it is set in page with screen 22, keyboard 23 and mouse 32's aid.

It is important to note that sheets can be printed in the usual way on both sides. Whereas, because it is about a relief printing, the Braille printed sheets can only be printed on one side, preferably on the back side in order to read them on the front side.

Also as Braille characters are usually bigger than printed characters usually used in newspapers, magazines or books, it could be necessary to select the part of the text to be printed in the usual way and that we want to convert and to print in Braille.

The texts and images set in page are then printed in white and black on transparent sheets, thanks to a classic printer 24, for example of the laser type. We thus obtain films 25, in the ratio of one film per page to be printed in the usual way, and of one film per page of the Braille text.

If we want to carry out colour printing, it is necessary to make one film per colour and sheet (4 films to perform four colour printing).

Films 25 are useful to produce printing plates of little thickness, made in deformable materials. One of the plate's sides that is suitable for support could be covered, for example, by an adhesive layer in order to be fixed and to totally cover the cylindrical surface that is useful to print blanket carrier cylinder 1 or, according to the invention, a margin cylinder 5.

Plates 35 for the offset machines are obtained, for example, thanks to a technique of photomechanical development 33. Plates 34 used to this end comprise a photosensitive layer which, by heatstroke through film 25 and of a photographic development, are provided of areas that attract fatty bodies (ink) and reject water, and of areas that react on the contrary.

Printing plates 35 that have been manufactured in this way are fixed to plate carrier cylinders 1 of the different printing posts of the offset printing chain.

Braille printing plate is done from an engraved plate 20 so that the characters in Braille appear in relief, in form of wedges (picks) in the surface of printing plate 27 obtained this way.

For this purpose, a classic technique of photoengraving 26 due to erosion can be applied.

For example, plate 20, 27 can be made of brass, with a thickness inferior to 0,5 mm, preferably inferior to 0,4 mm and the eroded areas of plate 27 should have a thickness more or less the same as half the thickness of non eroded areas.

The printing chain represented in drawing 2 is composed by 4 printing posts 28 to 31, similar to the one described in reference to drawing 1, an intermediate sheets reversing post 32, located between posts 29 and 30, to allow printing on both sides, a feeding post 6' where the virgin sheets to be printed are situated, and a reception post 9' where the sheets are being heaped up once printed.

Braille printing plate 27 is fixed to one of the margin clyinders 31 of posts 28 to 31, according to which side we want to print in Brille, whereas offset printing plates 35 are fixed to plate carrier cylinders 1 of the other printing posts.

I claim:

1. Printing method combining normal printing with Braille printing, using an offset printing machine having at least one printing post that comprises a plate carrier cylinder where a printing plate, containing a motif to be printed and receiving ink, is fixed, a blanket carrier cylinder where a reversed image of the motif on the printing plate is transferred from the plate carrier cylinder, and a margin cylinder, the method comprising the following steps:

setting a page of at least one of text and images to be printed, setting a page of text to be printed in Braille, printing one film for each said page of at least one of text and images, printing one film per page in Braille, producing a motif printing plate for each said film having at least one of text and images and producing a Braille printing plate for each said film having Braille, the motif printing plate and the Braille printing plate having la support side and a printing side, fixing the Braille printing plate by its support side to the margin cylinder of one the at least printing post, fixing the motif printing plate by its support side to the plate carrier cylinder of the at least one printing post, and printing sheets by passing the sheets one by one through the blanket carrier cylinder and the counter-pressure cylinder of the at least one printing post.

2. The method in accordance with claim 1, wherein the Braille printing plate is produced by an erosion photoengraving technique.

3. The method in accordance with claim 1, wherein at least a part of the text to be printed is automatically converted to Braille text.

4. The method in accordance with claim 1, wherein the sheets are printed on both sides.

5. The method in accordance with claim 1, wherein the Braille printing plate covers the margin cylinder.

6. The method in accordance with claim 1, wherein the Braille printing plate has a thickness less than 0.5 mm and eroded areas of the Braille printing plate have a thickness substantially half of the thickness of non-eroded areas.

* * * * *